US006678959B1

(12) United States Patent
Phillip et al.

(10) Patent No.: US 6,678,959 B1
(45) Date of Patent: Jan. 20, 2004

(54) GROUT REMOVAL TOOL

(75) Inventors: William Phillip, Hartford, WI (US); Lonnie E. Middleton, Kaufman, TX (US)

(73) Assignee: Midwest Trade Tool, Inc., Butler, WI (US)

( * ) Notice: Subject to any disclaimer, the term of this patent is extended or adjusted under 35 U.S.C. 154(b) by 0 days.

(21) Appl. No.: 09/560,042

(22) Filed: Apr. 27, 2000

Related U.S. Application Data

(60) Provisional application No. 60/143,212, filed on Jul. 9, 1999.

(51) Int. Cl.[7] ..... B26B 7/00

(52) U.S. Cl. ..... 30/277.4; 172/304; 172/500; 451/356; 125/12

(58) Field of Search ..... 30/277.4, 357, 30/392, 304, 314, 172, 500; 451/356; 125/22, 12; 83/875

(56) References Cited

U.S. PATENT DOCUMENTS

| | | | | | |
|---|---|---|---|---|---|
| 632,287 | A | * | 9/1899 | Swacick | 30/357 X |
| 833,528 | A | * | 10/1906 | Jones | 125/22 |
| 2,830,368 | A | * | 4/1958 | Knoll et al. | 30/277.4 |
| 3,251,129 | A | * | 5/1966 | Knoll | 30/277.4 |
| 3,307,242 | A | * | 3/1967 | Cofran | 125/22 X |
| 3,553,905 | A | * | 1/1971 | Lemelson | 30/357 X |
| 3,646,675 | A | * | 3/1972 | Wezel | 30/277.4 X |
| 3,888,004 | A | * | 6/1975 | Coleman | 30/277.4 |
| 3,892,039 | A | * | 7/1975 | Fisher | 30/314 X |
| 4,128,970 | A | * | 12/1978 | Sawrenko | 451/356 |
| 4,756,085 | A | * | 7/1988 | Lebessis | 30/277.4 |
| 4,953,301 | A | * | 9/1990 | Dobbs, Jr. | 30/392 |
| 5,505,189 | A | * | 4/1996 | Chiuminatta et al. | 125/12 |
| 5,809,657 | A | | 9/1998 | Mortensen | 30/392 |
| 5,885,144 | A | * | 3/1999 | Martin et al. | 451/356 |
| 6,149,510 | A | | 11/2000 | Romagnoli | 451/356 |

OTHER PUBLICATIONS

Tile–Vac Dustless Joint Removal System, Dustless Tile Vac.System, (Date Unknown).

Dustless Grout Remover flyer, Tile EZ USA Inc., (Date Unknown).

Dustless Grout Remover, Tile EZ USA Inc., (http://www.tile–eze.com/fein.html, Jun. 29, 1999).

Grout Removal Attachment Kit web page, Dremel, (http://www.dremel.com/whatsnew/whatsnew.html, Dec. 10, 1999).

"A Must Have Grout Master Dustless Grout Remover!", Midwest Trade Tool, Inc., (Date Unknown).

* cited by examiner

*Primary Examiner*—Charles Goodman
(74) *Attorney, Agent, or Firm*—Craig A. Fieschko, Esq.; DeWitt Ross & Stevens S.C.

(57) ABSTRACT

A grout removal tool includes an adapter having a replaceable cutting blade mounted thereon. The adapter is configured to be installed within a common reciprocating saw. The adapter has a proximal attachment end for attachment to the saw, an elongated proximal leg extending from the proximal attachment end, and an elongated distal leg extending from the proximal leg at an angle to terminate in a distal end whereupon the cutting blade is attached. When the proximal attachment end of the adapter is installed within the reciprocating saw, the cutting blade reciprocates in a parallel plane beneath the plane in which the proximal leg reciprocates. When the cutting blade is reciprocated across a grouted work surface, it results in a high rate of grout removal with low dust dispersion.

31 Claims, 2 Drawing Sheets

GROUT REMOVAL TOOL

CROSS-REFERENCE TO RELATED APPLICATIONS

This application claims priority under 35 USC §119(e) to U.S. Provisional Patent Application No. 60/143,212 filed Jul. 9, 1999, the entirety of which is incorporated by reference herein.

FIELD OF THE INVENTION

This disclosure concerns an invention relating generally to tools for removing grout from joints between tiles and other grout-sealed surfaces, and more specifically to power tools for effecting grout removal.

BACKGROUND OF THE INVENTION

In the field of tile installation, removal, and renovation, it is frequently desirable to be able to remove tiles from tiled surfaces. In order to do so, the grout seals between the tiles must be removed. There are presently several known grout removal tools for performing this task.

Initially, hand-held grout removal tools are known whereby a user may guide a blade within a grout joint to manually cut or grind the grout away by use of a sawing motion. Generally, these provide an elongated handle which extends towards a blade retainer, wherein blades are removably received. While these hand-held tools are inexpensive, they are tiring and time-consuming to use. However, one advantage of manual grout removal is that it is generally less forceful and more easily controlled than when power grout removal is performed. This can be important when there is a need to avoid tile damage and preserve the tiles for reuse, e.g., in the case of rare and expensive hand-painted tiles, and/or where the tile work is intricate and requires a high degree of tool control.

Rotary-mode power grout removal tools generally involve a rotating abrasive disc which is fit into the grout joint and spun against the grout. The housing for the disc may include rollers or similar guiding apparata which help users to guide the blade along a joint and/or adjust the depth of cut. While these can rapidly remove grout, they generate a great deal of dust; for this reason, some rotary-mode grout removers incorporate vacuum systems for cleaner operation. The rotary-mode tools also have the disadvantage that they are more difficult to control and cannot be used for intricate work, and they can cause greater damage to file edges is they are not carefully used.

Vibration-mode power grout removal tools generally involve a planar chisel or blade which fits within the grouted joint, and which is then vibrated at high frequency (around 365 Hz) and low amplitude (approximately 1 mm) along an axis parallel to or perpendicular to the blade's edge. These tools are exemplified by the Fein grout removal tool, which vibrates the blade parallel to its edge and which is well known in the tile trade for its relatively dust-free operation. The blade fits within the grout joint and rapidly grinds through the grout with low damage to the surrounding tiles. Straight chisel-like blades, circular disc blades, and sickle-type blades may be interchangeably accommodated within the tool. Speed control is used to keep the speed constant under a variety of loading conditions, which is believed to enhance performance. Vibration-mode tools are generally regarded by those in the tile removal and installation trade to be the best tools available because they are "gentle" on tile, and they have low clean-up burden; unfortunately, they are also among the most expensive grout removal tools, and they are not as fast as rotary removal tools.

For competitive reasons, power grout removal is a virtual necessity for tile professionals in the present market. Manual grout removal is simply too slow (and thus too expensive) for the consumer to bear. Occasional exceptions exist, e.g., in the case where the tile professional is working on antique or fancy tiles, wherein their expense is such that the consumer is willing to pay the price of manual grout removal in order to spare the tiles. Additionally, dustless grout removal, or grout removal with minimal dust, has become increasingly important for contractors owing to the wasted time and diminished efficiency resulting from dust clean-up. Grout dust is extremely fine, is readily sent airborne for settling on distant household surfaces, and is irritating to the eyes and lungs. It is therefore desirable to have available other power grout removal tools which allow for rapid grout removal; which have minimal dust generation and dispersion; which allow for a high degree of control, so that they may be used with intricate tile work; and which provide grout removal with little or no damage to the surrounding tile.

SUMMARY OF THE INVENTION

The invention, which is defined by the claims set out at the end of this disclosure, is directed to a grout removal tool which addresses the previously-noted problems, and which provides advantages unavailable in prior grout removal tools. A particularly preferred version of the grout removal tool includes a proximal end adapted to be attached within a power reciprocating saw, and an opposing distal end having a cutting edge. Between the proximal attachment end and the distal cutting end, an elongated proximal leg extends from the proximal attachment end to join an elongated distal leg which descends at an angle toward the distal cutting end. The proximal leg is oriented at least substantially parallel to the cutting edge of the tool (and also the reciprocation axis along which the tool reciprocates within the saw) so that when the tool is reciprocated along a grouted work surface, at least a major portion of the cutting edge is placed in use, resulting in a higher rate of grout removal.

Within the grout removal tool, the proximal attachment end is preferably provided on an adapter, and the cutting edge is provided on one or more cutting blades which are replaceable on the distal end of the adapter. The cutting blades each affix to opposing planar sides of the adapter at two or more attachment points, and these attachment points are preferably situated along a line which is oriented at an angle to the reciprocation axis. As a result, the forces/stresses between the cutting blades and the adapter are distributed across the blade and the distal end of the adapter during reciprocation, resulting in less wear and greater durability. Additionally, the opposing planar sides of the adapter upon which the blades are affixed preferably slope inwardly towards each other so that the cutting blades installed thereon are oriented at an angle during cutting. For reasons discussed elsewhere in this document, this is believed to result in lesser wear of the cutting blade, as well as lesser grout dust dispersion. The cutting edge preferably has a nonplanar shape, preferably an arcuate one. As a result, when cutting begins, the initial contact area between the cutting edge and the grout is smaller, resulting in greater initial grout penetration.

The grout removal tool has been found to provide an extremely high rate of grout removal, one rivaling rotary-mode grout removal tools. However, unlike rotary-mode tools, the tool that is the subject of this document is extremely easy to control, and can be used for high-precision grout removal without damaging the surrounding tile. Additionally, the tool provides extremely low dust generation (on the order of that of the vibration-mode grout removal tools), but at far lower cost. Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
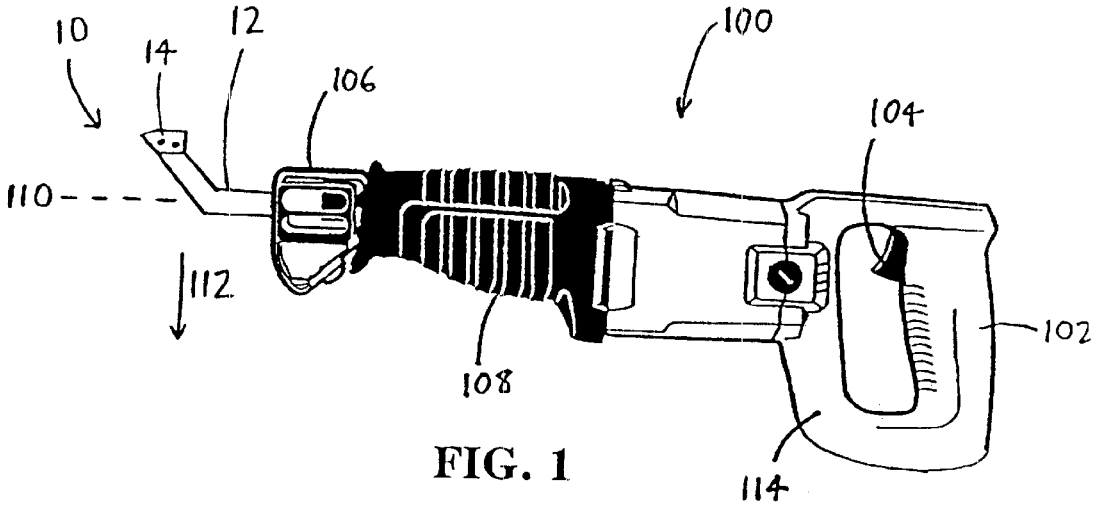
FIG. 1 is a side perspective view of a preferred embodiment of a grout removal tool shown installed on a reciprocating saw.

Initially referring to FIG. 1 of the drawings, the grout removal tool 10 is shown in a ready-to-use state installed within a common reciprocating saw 100 in place of the reciprocating saw's blade. Before discussing the grout removal tool 10 in greater detail, it will first be helpful to briefly discuss the structure and operation of reciprocating saws.

Reciprocating saws 100 are commonly used in carpentry and woodworking fields for cutting thin sheets of wood. The reciprocating saw 100 of FIG. 1 is an exemplary one, and it should be understood that reciprocating saws 100 that can be used with the grout removal tool 10 may have a wide variety of configurations other than the one illustrated. However, the reciprocating saw 100 of FIG. 1 has several features which are exemplary of most reciprocating saws: a handle 102 with a trigger 104 for actuating cutting; a blade mount 106 wherein the reciprocating saw blade (not shown) is mounted; and an elongated motor housing 108 extending between the handle 102 and the blade mount 106. Reciprocating saws of this type are manufactured by a wide variety of manufactures, such as Black & Decker/DeWalt (Hampstead, Md.), Milwaukee/Sawzall (Brookfield, Wis.), Porter-Cable (Jackson, Tenn.), Makita (La Mirada, Calf.), Delta (Tupelo, MS), Skil/Bosch (Chicago, Ill.), and they commonly include such features as pneumatic, 120 volt, and/or battery-powered operation; variable speed control; and rapid blade replacement. As noted above, in FIG. 1, the blade mount 106 of the reciprocating saw 100 is illustrated as accommodating the grout removal tool 10 rather than a reciprocating saw blade. No power source for the reciprocating saw 100 is illustrated, but a common reciprocating saw 100 would generally have an electric power cable, battery, or pneumatic hose protruding from it somewhere near its handle.

When a reciprocating saw 100 is used for its ordinary and intended purpose, an elongated reciprocating saw blade having a single serrated edge has one of its ends installed within the blade mount 106 so that it extends outwardly along a reciprocation axis (labeled as 110 in FIG. 1), which is generally situated at or adjacent to the lengthwise axis of the reciprocating saw 100. Reciprocating saw blades come in a variety of lengths, with average lengths being approximately 8–12 inches for carpentry applications. The ends of reciprocating saw blades that are to be installed within the blade mounts 106 generally have complex key-like shapes which are specially designed to fit within complementary structures in the blade mounts 106 to firmly secure the saw blade ends therein.

After the reciprocating saw blade is installed within the blade mount 106, the serrated edge of the blade—which may be said to define its cutting axis—rests parallel to the reciprocation axis 110, with the teeth facing the direction indicated by the arrow 112 (downwardly towards the reciprocating saw handle 114). The trigger of the reciprocating saw 100 is then actuated to cause the blade to reciprocate along its length. When using a reciprocating saw, the user holds the reciprocating saw 100 with his/her forearm oriented generally parallel to the reciprocation axis 110, with its cutting axis (and reciprocation axis 110) being oriented at an angle to the surface to be cut. Thus, the cutting action is different from jigsaws, wherein the blade reciprocates along an axis perpendicular to the workpiece; circular saws, wherein a circular blade rotates within an axis perpendicular to the workpiece; and other types of power saws.

It is noted that a reciprocating saw 100, when used in conjunction with a reciprocating saw blade, would generally be unsuitable for grout removal. The size, configuration, and speed of the saw blade would result in poor control of the saw (and tile damage), and significant dust dispersion would result from the rapid reciprocating action of the blade. Further, unless reciprocating saw blades of variable width were provided, the reciprocating saw 100 could not easily cope with grout joints having widths different from the saw blade: if the grout joint is narrower than the blade, the sides of the tile will be cut and damaged; and if the grout joint is wider than the blade, once the initial cut is made down the length of the grout joint, it would be difficult to direct the blade back through the joint to remove any grout remaining along the sides of the cut groove. Additionally, since a reciprocating saw blade reciprocates along a line situated at an angle to the surface being cut, it would be very difficult to cut within a grout joint because there is generally no exposed edge of the joint at which to begin cutting, and additionally the grout joint "workpiece" does not have an exposed back side—i.e., the user would effectively be cutting in a shallow hole with the blade bottoming out during every forward stroke. This would lead to high vibration, low control, and rapid blade wear.

Figure 2:
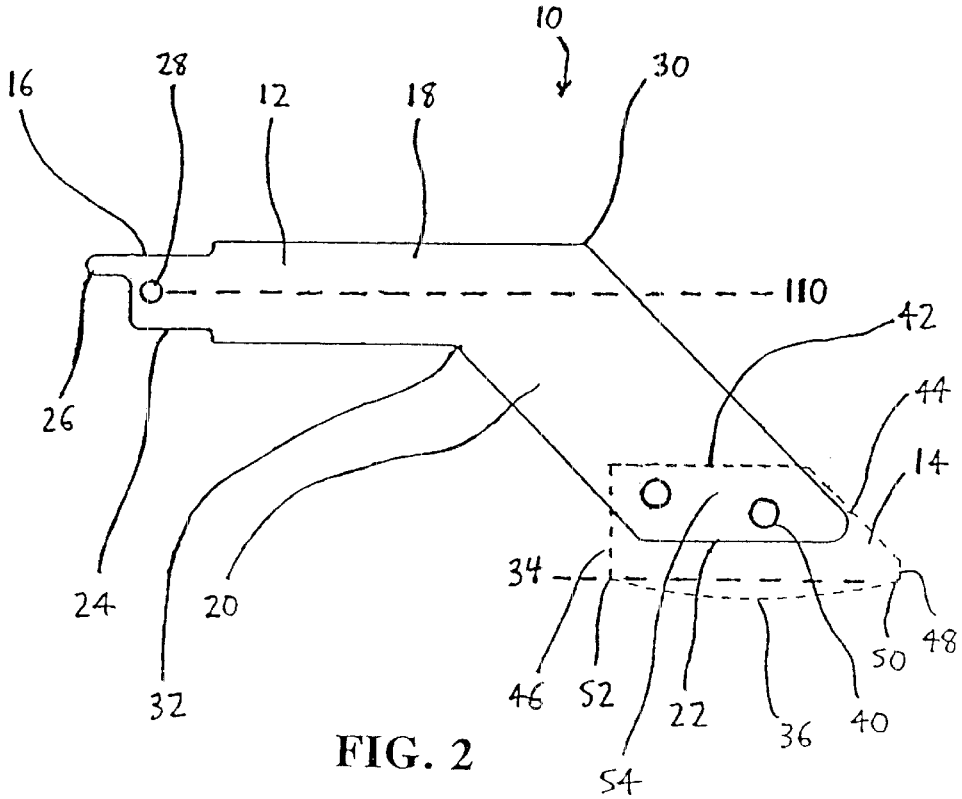
FIG. 2 is a side elevational view of the grout removal tool of FIG. 1 shown without the reciprocating saw, and with the grout removal tool's adapter shown in solid lines and its cutting blade shown in phantom (dashed) lines.
Figure 3:
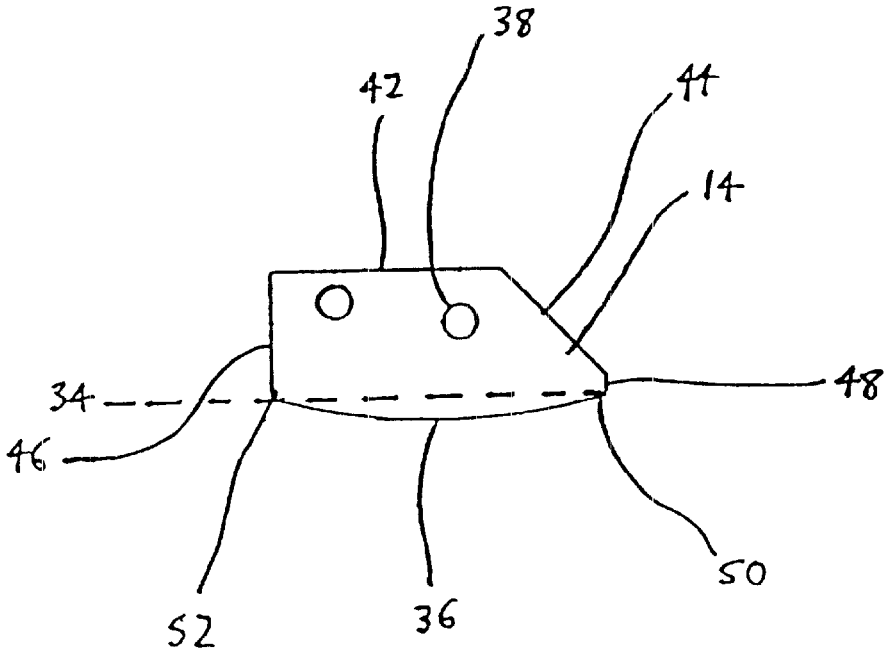
FIG. 3 is a side elevational view of the cutting blade of the grout removal tool of FIGS. 1 and 2.

Referring then to FIGS. 1 and 2, the grout removal tool 10 includes an adapter 12 (best seen in FIG. 2) and a cutting blade 14 (shown in phantom in FIG. 2 and by itself in FIG. 3). Looking particularly to FIG. 2, the adapter 12 includes a proximal end 16 which is adapted for installation within the blade mount 106 of a reciprocating saw 100; an elongated proximal leg 18 extending from the proximal end 16 in a direction oriented along (or at least substantially parallel to) the reciprocation axis 110 of the reciprocating saw 100; an elongated distal leg 20 extending at an angle from the proximal leg 18; and the distal leg 20 terminating in a distal end 22 whereupon the cutting blade 14 (or blades 14) is mounted. The adapter 12 is formed of steel plate approximately 0.1 inch thick, with the cutting blade(s) 14 then being formed of steel plate approximately 0.02–0.05 inches thick, though other materials and dimensions are possible.

It is noted that the grout removal tool 10 is preferably configured for installation within the reciprocating saw 100 in the fashion shown in FIG. 1, with the cutting blade 14 facing upwardly—in effect, installed upside-down in the reciprocating saw 100. As will be apparent from later discussion, with proper configuration of the distal leg 20, this allows the edge of the cutting blade 14 to rest above the top plane of the reciprocating saw 100. When the reciprocating saw 100 is held upside-down by the user, the cutting blade 14 may be reciprocated along the grout joint with its reciprocation axis 110 at least substantially parallel to the grout joint. This avoids the "stabbing" action and difficulties that the cutting blade 14 would encounter if it was instead operated with the reciprocation axis 110 at a significant angle with respect to the workpiece/grout joint. It is noted that in embodiments of the invention other than the one shown in the Figures, the distal leg 20 of the adapter 12 might be made longer so that the grout removal tool 10 need not be installed in an upside-down orientation in the reciprocating saw 100; however, a shorter distal leg 20 is preferred for higher control. Of course, if the handle 114 of the reciprocating saw 100 is sufficiently short that it does not cause interference with the operation of the grout removal tool 10 with the reciprocation axis 110 parallel to the surface of the grout joint, the arrangement of FIG. 1 could simply be used with the grout removal tool 10 being inverted from the arrangement shown in FIG. 1. Note, however, that since the arrangement of FIG. 1 will be more common (i.e., the reciprocating saw 100 will generally be used in an inverted condition to prevent interference from its handle 114), the remainder of this document will generally refer to the direction 112 as being the upward direction, and the opposite direction being the downward direction.

The proximal end 16 of the adapter 12 is configured in the manner of standard reciprocating saw blades so that it may be firmly secured within the blade mount 106 of the reciprocating saw 100. The proximal end 16 may include some or all of the following features, all of which are used to effect better attachment within the blade mount 106: (1) A necked region 24 wherein the width of the proximal end 16 is reduced, so that the necked region 24 may be complementarily received within a channel in the blade mount 106; (2) a protruding finger 26 extending from the proximal end 16, which bears against one or more surfaces in the blade mount 106 to resist rotation of the adapter 12 within its plane; and (3) an attachment hole 28, into which an attachment screw or another fastener may be inserted to firmly affix the adapter 12 within the blade mount 106. It should be understood that saw blade attachment schemes within blade mounts 106 may vary, and the attachment schemes used on adapter proximal ends 16 may vary as required to allow them to be affixed within the blade mounts 106 in question.

The proximal leg 18 is then formed as an elongated bar which extends from the proximal end 16 in such a manner that once the proximal end 16 is attached within the blade mount 106 of a reciprocating saw 100, the proximal leg 18 extends outwardly along the reciprocation axis 110 of the reciprocating saw 100. The proximal leg 18 preferably has a length of at least 2.5 inches between the proximal end 16 and the distal leg 20 (as measured between the proximal end 16 and a midpoint set between upper and lower corners 30 and 32), so that it may comfortably accommodate larger reciprocating saw 100 stroke lengths (e.g., 0.5 inches or more) without having the distal leg 20 interfere with the blade mount 106. If the proximal leg 18 is provided with greater length, this can enhance the visibility of the grouted surface upon which the grout removal tool 10 is working; however, it can also result in lesser control.

The distal leg 20 is also formed as an elongated bar, and it extends at a downward angle from the proximal leg 18 (i.e., from the reciprocation axis 110) to descend to the distal end 22 and cutting blade 14. The distal leg 20 preferably has a length of at least 1.5 inches so that when the adapter 12 is installed within most common reciprocating saws 100 with the proximal leg 18 (and reciprocation axis 110) resting at least substantially parallel to the surface/joint, the distal end 22 (and the cutting axis 34 of the cutting blade 14) may be comfortably situated below the reciprocation axis 110 on the surface/grout joint to be cut. As illustrated by the arrangement shown in FIG. 1, the length of the distal end 22 should be sufficient that the cutting blade 14 easily reaches the grouted work surface when the reciprocation axis 110 is oriented at or close to parallel to the work surface (i.e., the user should preferably not have to tip the reciprocating saw 100 with respect to the grouted work surface in order to reach it). As a result, the blade's cutting edge 36, which is at or approximated by the cutting axis 34, is driven back and forth along (i.e., at least substantially parallel to) the grout joint rather than "into" it (which would cause the reciprocating saw 100 to work much harder, and which would generate more dust). The distal leg 20 preferably descends from the proximal leg 18 at an angle of 45 degrees or less (measured from the reciprocation axis 110), rather than simply rapidly descending downward in a perpendicular fashion. A more acute orientation of the distal leg 20 with respect to the proximal leg 18 (i.e., a lower angle in relation to the reciprocation axis 110) results in gentler cutting and greater control of the cutting blade 14.

As should be particularly apparent from FIG. 2, the cutting blade 14 is removably affixed to the distal end 22 of the adapter 12 at two attachment points: a pair of blade fastener apertures 38 on the cutting blade 14 are complementarily oriented with respect to a pair of adapter apertures 40 on the adapter 12 to allow the insertion of fasteners (not shown) to affix the cutting blade 14and adapter 12 together. It is noted that the blade apertures 38 and adapter apertures 40 (or other attachment points, if a different attachment scheme is used) are preferably situated along a line which is not parallel to the reciprocation axis 110, as exemplified by the adapter apertures 40 illustrated in FIG. 2, which are oriented on a line at a slight angle to the reciprocation axis 110. This orientation is believed to increase the lifespan of the adapter 12 and cutting blade 14 since the fasteners extending through the apertures 38 and 40 will naturally exert force (and generate stress) along planes parallel to the surface being cut (and thus at least substantially parallel to the reciprocation axis 110). Therefore, by situating the apertures at different depths on the cutting blade 14 so that they are not both oriented along the same line parallel to the reciprocation axis 110, forces generated by the fasteners during cutting are not all exerted along the same plane, and wear is believed to be reduced. More than two attachment points could be used (e.g., three apertures 38/40 and fasteners could be used for attachment of the cutting blade 14 to the distal end 22 of the adapter 12), but it is then preferred that at least two of these attachment points be oriented in the foregoing manner (along a line which is oriented at an angle to the reciprocation axis 110).

Figure 4:
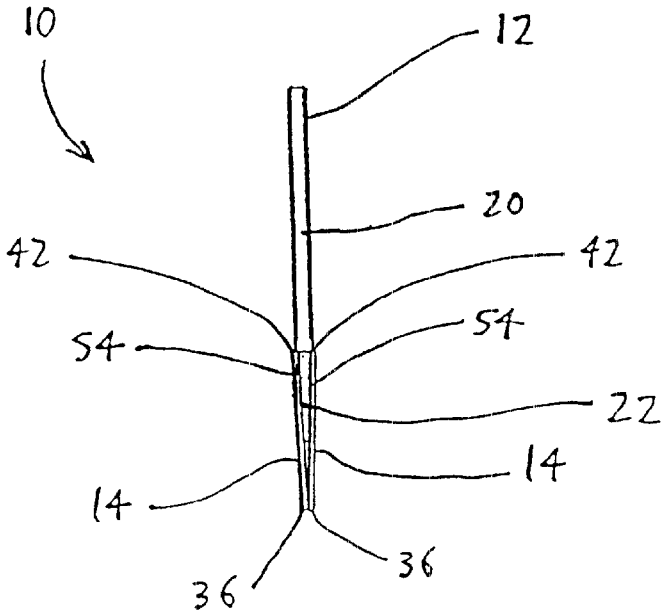
FIG. 4 is a front elevational view of the grout removal tool of FIG. 2 shown with two cutting blades installed on opposing sides of the adapter.

The cutting blade 14, which is best seen in FIGS. 3 and 4, includes the cutting edge 36, an opposing top edge 42, a front edge 44, and a rear edge 46. Preferably, the front edge 44 is situated at an angle of less than 90 degrees with respect to the cutting edge 36 so that the intersection of the front edge 44 and cutting edge 36 is a well-defined nose 48, since this is believed to enhance penetration and cutting of grout when the front edge 44 of the cutting blade 14 is driven through the grout. However, it is also preferable that the nose 48 between the front edge and cutting edge 36 be rounded, as illustrated in FIG. 1, since an overly-sharp vertex between the front edge 44 and cutting edge 36 could result in such deep penetration of the grout that the cutting blade 14 may have difficulty withdrawing.

The cutting edge 36 is preferably made abrasive by known methods such as by adhering diamond chips/dust, by applying granules of harder metal by sputtering, sintering, or other methods known to the art, or by roughening the surface of the cutting blade 14 around the cutting edge 36. The cutting edge 36 is bounded in the frontward-to-rearward direction by a edge forward end 50 and an edge rear end 52 (through which the cutting axis 34 extends), and is preferably oriented at least substantially parallel to the length of the proximal leg 18 (i.e., to the reciprocation axis 110), but with a slight degree of curvature so that it has an arcuate shape (as illustrated in FIGS. 2 and 3). By orienting the cutting edge 36 at least substantially parallel to the reciprocation axis 110, at least a major portion of the cutting edge 36 is exposed to the grout during each stroke of the reciprocating saw 100, thereby speeding the cutting effort. Other cutting blade 14 configurations are possible, e.g., a cutting blade 14 having more extreme curvature (e.g., a semicircular cutting edge 36); however, in this case a lesser portion of the cutting blade 14 is in contact with the grout at any given time and less grout is removed.

To adapt the grout removal tool 10 to grout joints having different widths, it is contemplated that the adapter 12 may have either one or several cutting blades 14 attached at its distal end 22. When a single cutting blade 14 is used, it can be affixed to either one of the opposing planar sides 54 of the distal end 22. When the width of the cut in the grout joint is to be increased, additional blades can be affixed on one or both of the planar sides 54 of the distal end 22 (with FIG. 4 illustrating two cutting blades 14 affixed to the opposite sides 54 of the adapter 12). When multiple blades 14 are added to the distal end 22, they collectively establish the cutting edge 36 and combine to remove grout over a wider region.

Referring particularly to FIG. 4, it is noted that the distal end 22 of the adapter 12 has a wedge-like shape wherein the opposing planar sides 54 of the distal end 22 slope inwardly as they progress towards the cutting edge 36. As a result, when multiple blades 14 are situated on opposing sides of the adapter 12—as illustrated in FIG. 4—they point inwardly so that their cutting edges 36 fit closely adjacent each other, or in abutment with each other. As a result, very little or no space exists between the cutting edges 36 of multiple blades 14 when they are situated on opposing sides of the distal end 22 of the adapter 12. This lack of effective space between the cutting edges 36 is believed to significantly contribute to dust reduction, since it retains a greater majority of the grout dust within the cut groove in the grout joint rather than lifting the dust outwardly to be dispersed in the air. The wedge-shaped configuration for the distal end 22 is also believed to result in longer life for the cutting blades 14. By affixing the cutting blade 14 on one side of the adapter 12 and using it until it begins to go dull, and then switching the cutting blade 14 to the other side of the adapter 12, the life of the cutting blade 14 may be extended since the diamond chips (or other abrasive) present on the planar sides 54 adjacent the cutting edge 36 are more fully utilized.

It is noted that most power reciprocating saws 100 have a stroke length between 0.75 inches–1.25 inches (or in some cases more), or can have their stroke length adapted to this range. This is a substantially greater range of motion than the amplitude of the vibrating-mode grout removal tools, and grout removal using the grout removal tool 10 is much faster than with vibrating-mode tools. It might be expected that the significantly greater rate of grout removal would also result in significantly greater dust generation; however, it has been found that this is not the case.

It is further noted that the grout removal tool 10 may also be used in a jigsaw or similar type of reciprocating-action tool. In a jigsaw, the cutting axis of its saw blade is oriented perpendicular to the workpiece; naturally, the grout removal tool 10 cannot be operated in this orientation when configured as shown in FIG. 1. Therefore, the jigsaw would need to be rotated and held in an operating position wherein the cutting axis of the grout removal tool 10 is oriented at least substantially parallel to the grout joint. This is not as convenient or comfortable as the use of a reciprocating saw 100, and thus the use of a reciprocating saw (and the arrangement of FIG. 1) is greatly preferred.

It is understood that the foregoing description merely describes a single particularly preferred version of the invention to illustrate various advantageous features that may be included in the invention. The invention is not intended to be limited to the preferred version described above, but rather is intended to be limited only by the claims set out below. Thus, the invention encompasses all alternate embodiments that fall literally or equivalently within the scope of these claims.

What is claimed is:

1. A grout removal tool comprising:

a. a proximal end adapted for securement within a power reciprocating saw;

b. a distal end having two or more blades thereon, each blade having opposing faces, wherein the faces of the blades are adjacently situated in at least substantially parallel and fixed relation so the blades together define a cutting edge;

c. an elongated proximal leg extending from the proximal end, the proximal leg being oriented at least substantially parallel to the cutting edge; and d. an elongated distal leg extending between the proximal leg and the distal end, the length of the distal leg being oriented at an angle to the length of the proximal leg.

2. The grout removal tool of claim 1 wherein the proximal end includes at least one of:

a. a necked region, b. a protruding finger, and c. an attachment hole, whereby the proximal end may be firmly secured within the power reciprocating saw.

3. The grout removal tool of claim 1 wherein each blade is removably affixed to the distal end at two or more attachment points, and wherein at least one pair of each blade's attachment points is situated along a line which is oriented at an angle to the cutting edge.

4. The grout removal tool of claim 1 wherein the distal end is defined by a substantially flat member having opposing substantially planar sides wherebetween the cutting edge is located, and wherein the sides slope inwardly towards the cutting edge.

5. The grout removal tool of claim 1 in combination with a power reciprocating saw or jigsaw.

6. The grout removal tool of claim 1 wherein the blades are removably affixed to the distal end.

7. A grout removal tool comprising:

a. an adapter having a proximal end and a distal end, the proximal end being adapted for securement within a reciprocating saw;

b. a blade removably affixed to the distal end of the adapter, the blade having a cutting edge defined thereon;

the cutting edge extending between a forward end and a rear end, with an axis defined between the forward and rear ends constituting a cutting axis, and wherein the blade is removably affixed to the distal end of the adapter at two attachment points, the attachment points being situated along a line situated at an angle to the cutting axis; and c. one or more supplemental blades removably affixed to the distal end of the adapter, with all blades being adjacently arrayed in at least substantially parallel and fixed alignment.

8. The grout removal tool of claim 7 in combination with a power reciprocating saw or jigsaw.

9. A grout removal tool comprising:

a. an adapter including:

(1) a proximal end;

(2) a proximal leg extending forwardly from the proximal end along an at least substantially linear path;

(3) a distal leg extending forwardly from the proximal leg, wherein at least a substantial portion of the distal leg descends at an angle from the path of the proximal leg;

(4) a distal end situated forward of the distal leg and opposite the proximal end, the distal end having opposing sloped sides which converge inwardly towards each other in a descending direction;

b. a blade removably affixed to one of the sloped sides of the distal end, the blade having a lower cutting edge defined thereon; and wherein the distal end does not form a part of the cutting edge.

10. The grout removal tool of claim 9 wherein the blade is removably affixed to one of the sides of the distal end of the adapter by two or more attachment points, and wherein at least two of the attachment points are situated along a line which is not parallel to the cutting edge.

11. The grout removal tool of claim 9 wherein a length of the proximal leg adjacent the proximal end has generally uniform shape save for one or more discontinuities being defined therein, the discontinuities being defined by at least one of:

a. a necked region, b. a protruding finger, and c. an attachment hole, whereby the proximal end is adapted for attachment in a power reciprocating action tool via grasping of the discontinuities.

12. The grout removal tool of claim 9 wherein the cutting edge is arcuate.

13. The grout removal tool of claim 9 wherein the blade is defined by:

a. a top edge opposite the cutting edge;

b. a front edge situated between the top edge and the cutting edge, and opposite the distal end of the adapter; and c. a rear edge situated opposite the front edge, wherein the front edge is situated at an angle of less than 90 degrees with respect to the cutting edge.

14. The grout removal tool of claim 9 in combination with a power reciprocating saw or jigsaw.

15. The grout removal tool of claim 9 wherein the blade is affixed to one of the sides of the distal end with a supplemental blade affixed to the opposite side of the distal end, so that the blade and supplemental blade rest in at least substantially parallel adjacent relation.

16. The grout removal tool of claim 9 wherein the distal end of the adapter has opposing substantially planar sides below which the cutting edge is located.

17. A grout removal tool comprising:

a. an adapter having a proximal end and a distal end which is at least substantially flat, the proximal end being adapted for securement within a reciprocating saw, and the distal end having opposing sloped sides each converging slopes inwardly toward the other;

b. a blade removably affixed to one of the opposing sloped sides of the distal end of the adapter, the blade having a cutting edge defined thereon; and wherein the distal end does not form a part of the cutting edge.

18. The grout removal tool of claim 17 comprising two or more blades, each being removably affixed at one of the opposing sides of the distal end of the adapter, wherein the cutting edges of the blades are adjacently aligned in at least substantially parallel relation.

19. The grout removal tool of claim 18 wherein each blade is removably affixed to the distal end at two or more attachment points, and wherein at least one pair of each blade's attachment points is situated along a line which is oriented at an angle to the cutting edge.

20. The grout removal tool of claim 17 wherein the blade is removably affixed to the distal end at two or more attachment points, and wherein at least one pair of the blade's attachment points is situated along a line which is oriented at an angle to the cutting edge.

21. The grout removal tool of claim 20 comprising two or more blades, each being removably affixed at one of the opposing sides of the distal end of the adapter, wherein the cutting edges of the blades are adjacently aligned in at least substantially parallel relation.

22. The grout removal tool of claim 17 wherein the cutting edge is arcuate.

23. The grout removal tool of claim 17 in combination with a power reciprocating saw or jigsaw.

24. The grout removal tool of claim 17 wherein the adapter is defined by an at least substantially flat member.

25. A grout removal tool comprising:

a. an adapter having a proximal end and a distal end, the proximal end being adapted for securement within a reciprocating saw, and the adapter extending forwardly and downwardly from the proximal end to the distal end, the distal end having opposing sides;

b. two or more blades, each having a cutting edge defined thereon and being removably affixed to one of the opposing sides of the distal end of the adapter, the cutting edges of the blades being adjacently and fixedly aligned in a parallel row; and wherein the cutting edges together define a grout removal cutting edge.

26. The grout removal tool of claim 25 wherein at least one of the sides of the distal end slopes inwardly toward the other.

27. The grout removal tool of claim 26 wherein each blade is removably affixed to the distal end at two or more attachment points, and wherein at least one pair of each blade's attachment points is situated along a line which is oriented at an angle to the cutting edge.

28. The grout removal tool of claim 25 wherein each blade is removably affixed to the distal end at two or more attachment points, and wherein at least one pair of each blade's attachment points is situated along a line which is oriented at an angle to the cutting edge.

29. The grout removal tool of claim 28 wherein at least one of the sides of the distal end slopes inwardly toward the other.

30. The grout removal tool of claim 25 wherein the cutting edge is arcuate.

31. The grout removal tool of claim 25 in combination with a power reciprocating saw or jigsaw.

* * * * *